US009527323B2

(12) United States Patent
Tsubota

(10) Patent No.: US 9,527,323 B2
(45) Date of Patent: Dec. 27, 2016

(54) LIQUID DISCHARGING APPARATUS

(71) Applicant: SEIKO EPSON CORPORATION, Tokyo (JP)

(72) Inventor: Shinichi Tsubota, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/001,921

(22) Filed: Jan. 20, 2016

(65) Prior Publication Data

US 2016/0263923 A1 Sep. 15, 2016

(30) Foreign Application Priority Data

Mar. 12, 2015 (JP) ..... 2015-049848

(51) Int. Cl.
*B41J 29/377* (2006.01)

(52) U.S. Cl.
CPC ..... *B41J 29/377* (2013.01)

(58) Field of Classification Search
CPC ..... B41J 2/165; B41J 2/16552; B41J 2/1714; B41J 2/04566; B41J 11/0005; B41J 2/16505; B41J 2002/16555; B41J 2/16579; B41J 2002/16502
See application file for complete search history.

(56) References Cited

U.S. PATENT DOCUMENTS

2011/0109710 A1* 5/2011 Miyakoshi ..... B41J 2/165 347/104
2013/0241992 A1* 9/2013 Shimizu ..... B41J 2/16505 347/29
2015/0035925 A1 2/2015 Kitagishi

FOREIGN PATENT DOCUMENTS

JP 2013-15110 A 8/2013

* cited by examiner

*Primary Examiner* — Thinh H Nguyen
(74) *Attorney, Agent, or Firm* — Workman Nydegger

(57) ABSTRACT

A printing apparatus includes a housing portion that forms an internal space, a transportation mechanism that transports a medium so as to cause the medium to pass through the internal space, a liquid discharging head that is installed in the internal space and discharges ink onto the medium, and a first gas feeding mechanism that ejects gas onto the medium through an ejection port at a downstream side in a transportation direction of the medium when seen from the internal space.

13 Claims, 5 Drawing Sheets

LIQUID DISCHARGING APPARATUS

BACKGROUND

1. Technical Field

The present invention relates to a technique of discharging liquid such as ink onto a medium.

2. Related Art

An existing liquid discharging apparatus in which a liquid discharging head for discharging liquid through a plurality of nozzles onto a medium such as print paper is installed in a space (hereinafter, referred to as "internal space") in a housing portion has been proposed. For example, JP-A-2013-151110 discloses a configuration in which a heating mechanism for rapidly drying ink on a surface of a medium discharged from an internal space by heating the medium is installed in a large format printing apparatus capable of performing printing on a large-sized medium.

In the configuration as disclosed in JP-A-2013-151110, outside air heated by the heating mechanism enters the internal space so that the internal space can be dried. Accordingly, there is a possibility that the liquid is thickened in nozzles because of water evaporation or the like, for example, and appropriate discharge of the liquid is inhibited, as a result. In the above description, the case in which the outside air is heated by the heating mechanism has been described for the convenience. However, when it is supposed that the printing apparatus is used under a high-temperature environment, for example, the above-described problem that the internal space is dried due to the entrance of the outside air possibly occurs even in the configuration with no heating mechanism being installed. In consideration of the above circumstances, an advantage of some aspects of the invention is to suppress the entrance of the outside air into the internal space in which the liquid discharging head is installed.

SUMMARY

A liquid discharging apparatus according to an aspect of the invention includes a housing portion that forms an internal space, a transportation mechanism that transports a medium so as to cause the medium to pass through the internal space, a liquid discharging head that is installed in the internal space and discharges liquid onto the medium, and a first gas feeding mechanism that ejects gas onto the medium through a first ejection port at an upstream side or a downstream side in a transportation direction of the medium when seen from the internal space. With the above configuration, the gas is ejected onto the medium from the first gas feeding mechanism at the upstream side or the downstream side in the transportation direction of the medium when seen from the internal space. Accordingly, entrance of the outside air into the internal space in which the liquid discharging head is installed can be suppressed.

In the liquid discharging apparatus according to a preferred aspect of the invention, the first ejection port has a shape elongated in a direction intersecting with the transportation direction of the medium. In the above aspect of the invention, the first ejection port is formed to have the shape elongated in the direction intersecting with the transportation direction of the medium. Therefore, layered air flow is formed with the gas that is ejected through the first ejection port. Accordingly, the above-described effect that the entrance of the outside air into the internal space is suppressed is obtained extremely remarkably.

The liquid discharging apparatus according to a preferred aspect of the invention includes a second gas feeding mechanism that ejects gas onto the medium through a second ejection port between the first ejection port and the internal space. With the above configuration, the gas is ejected through both of the first ejection port and the second ejection port. Therefore, the above-described effect that the entrance of the outside air into the internal space is suppressed is obtained extremely remarkably in comparison with the configuration in which the gas is ejected through only the first ejection port. For example, with the configuration in which the second gas feeding mechanism ejects humidified gas onto the medium so as to supply the humidified gas into the internal space, there are advantages that the entrance of the outside air into the internal space can be suppressed and the internal space can be humidified by supply of the humidified air.

In the liquid discharging apparatus according to a preferable example of the aspect of the invention, which includes the second gas feeding mechanism, a flow rate of the gas that the second gas feeding mechanism ejects through the second ejection port is lower than a flow rate of the gas that the first gas feeding mechanism ejects through the first ejection port. In the above aspect of the invention, the flow rate of the gas through the second ejection port is lower than the flow rate of the gas through the first ejection port. Therefore, pressure toward the air flow of the first ejection port from the air flow of the second ejection port is generated. Accordingly, there is an advantage that excess supply of the humidified gas into the internal space is suppressed.

The liquid discharging apparatus according to a preferable example of the aspect of the invention, which includes the second gas feeding mechanism, includes a controller controlling at least one of a flow rate of the gas that is ejected by the first gas feeding mechanism and a flow rate of the gas that is ejected by the second gas feeding mechanism. In the above aspect of the invention, at least one of the flow rate of the gas that is ejected through the first ejection port and the flow rate of the gas that is ejected through the second ejection port is controlled. Therefore, there is an advantage that the pressure toward the air flow of the first ejection port from the air flow of the second ejection port (that is, an entrance amount of the humidified gas into the internal space) can be adjusted. In the liquid discharging apparatus according to a more preferable example of the aspect of the invention, a humidity detector that detects humidity of the internal space is installed and the controller controls at least one of the flow rate of the gas that is ejected by the first gas feeding mechanism and the flow rate of the gas that is ejected by the second gas feeding mechanism in accordance with the humidity detected by the humidity detector. In the above aspect of the invention, the entrance amount of the humidified gas into the internal space is adjusted in accordance with the humidity of the internal space, thereby obtaining an advantage that the internal space can be kept at an appropriate humidity.

With the configuration in which the heating mechanism installed at the outside of the internal space heats the medium, the outside air heated by the heating mechanism can enter the internal space. Therefore, the internal space is easy to be dried particularly. Accordingly, each of the above-described aspects capable of suppressing the entrance of the outside air into the internal space is extremely effective.

In the liquid discharging apparatus according to a preferred aspect of the invention, the first gas feeding mechanism is installed at the downstream side in the transportation direction of the medium when seen from the internal space and ejects the gas in a direction inclined to the downstream side in the transportation direction of the medium along a downward direction in a vertical direction. In the above aspect of the invention, the gas is ejected through the first ejection port in the direction inclined to the downstream side along the downward direction in the vertical direction. Accordingly, there is an advantage that generation of turbulent flow due to impact of the gas against the surface of the medium M can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
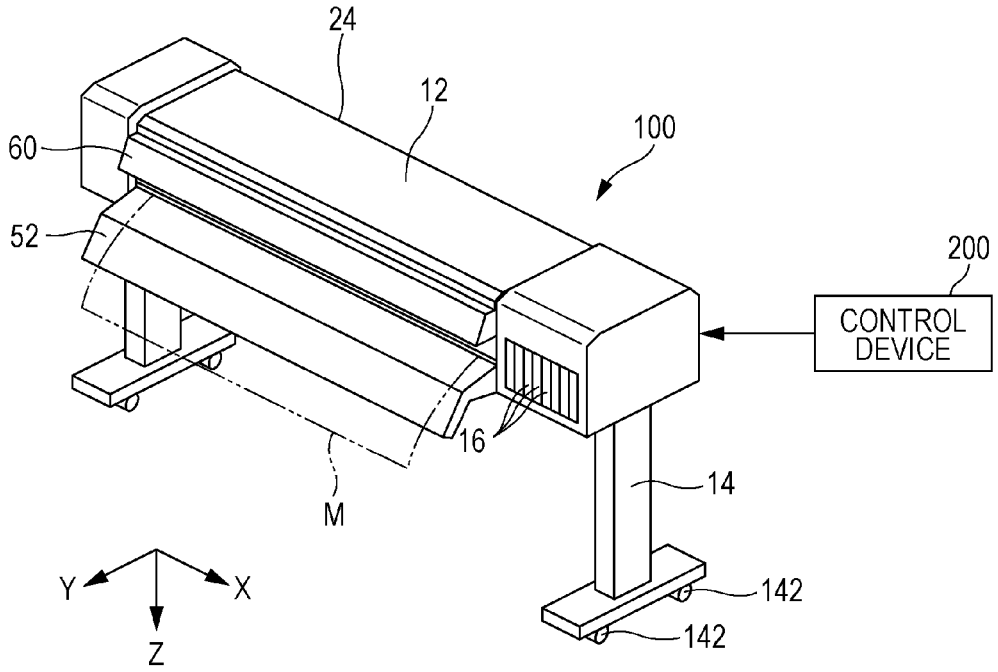
FIG. 1 is an external appearance view of a printing apparatus according to a first embodiment.

FIG. 1 is a view illustrating the configuration of a printing system according to a first embodiment of the invention. As illustrated in FIG. 1, the printing system in the first embodiment includes a printing apparatus 100 and a control device (host computer) 200. The control device 200 is configured by a personal computer, for example, and transmits, to the printing apparatus 100, a direction to the printing apparatus 100 and image data of an image to be printed.

The printing apparatus 100 in the first embodiment is a liquid discharging apparatus that discharges ink as an example of liquid onto a medium M so as to print an image on a surface of the medium M. The medium M is a recording medium such as print paper and a film as an ink discharge target. The printing apparatus 100 in the first embodiment is a printing apparatus (large format printer (LFP) capable of performing printing on the medium M of a large size (having a paper width of approximately 128 inches, for example) of equal to or larger than A2 defined by the International Standards. As illustrated in FIG. 1, the printing apparatus 100 includes a main body portion 12 and leg portions 14. The main body portion 12 is a structure elongated in an X direction corresponding to a width direction of the medium M. A plurality of liquid containers (cartridges) 16 storing therein inks of different types are mounted on the main body portion 12. The leg portions 14 support the main body portion 12 at a predetermined height. Wheels 142 for conveyance are installed on the bottom surfaces of the leg portions 14. In the following description, the vertical direction (up/down direction) is expressed as a Z direction and a direction (front/rear direction of the printing apparatus 100) perpendicular to an X-Z plane is expressed as a Y direction.

Figure 2:
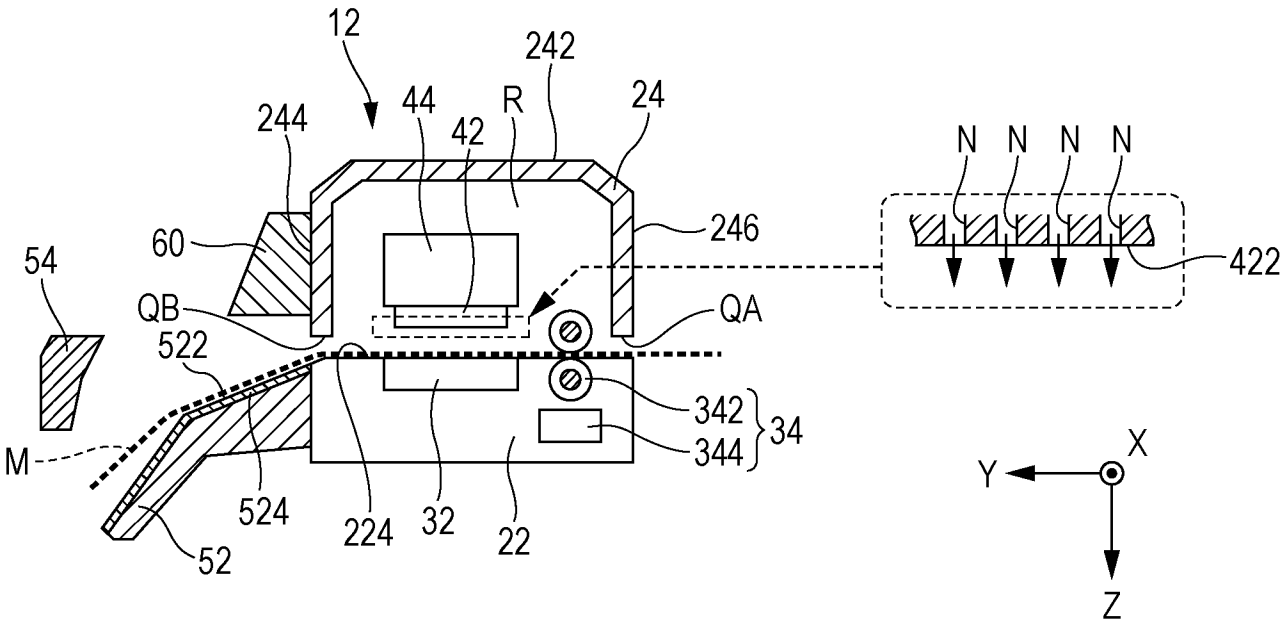
FIG. 2 is a cross-sectional view of the printing apparatus.

FIG. 2 is a cross-sectional view (cross-section parallel with a Y-Z plane) of the main body portion 12. As illustrated in FIG. 2, the main body portion 12 in the first embodiment includes a supporting body 22 and a housing portion 24. The above-described leg portions 14 are fixed to the supporting body 22 and the housing portion 24 can be opened/closed while being axially supported by the supporting body 22.

The supporting body 22 supports the medium M by a planar upper surface (hereinafter, referred to as "transportation surface") 224. The housing portion 24 is a structure forming a space (hereinafter, referred to as "internal space") R in the main body portion 12 and surrounds a space above the transportation surface 224 (so-called platen) of the supporting body 22. To be specific, the housing portion 24 includes a top surface portion 242 opposing the transportation surface 224 of the supporting body 22 with an interval therebetween, a front surface portion 244 projecting to a positive side in the Z direction (downward side in the vertical direction) from a peripheral edge of the top surface portion 242 at a positive side in the Y direction, and a rear surface portion 246 projecting to a positive side in the Z direction from a peripheral edge of the top surface portion 242 at a negative side in the Y direction. As illustrated in FIG. 2, an interval between the bottom surface of the rear surface portion 246 and the transportation surface 224 of the supporting body 22 corresponds to a supply port QA for supplying the medium M to the internal space R and an interval between the bottom surface of the front surface portion 244 and the transportation surface 224 of the supporting body 22 corresponds to a discharge port QB for discharging the medium M from the internal space R. That is to say, the internal space R in the first embodiment communicates with a space at the outside of the main body portion 12 through the supply port QA and the discharge port QB.

As illustrated in FIG. 2, a suction mechanism 32 and a transportation mechanism 34 are installed on the transportation surface 224 of the supporting body 22. The suction mechanism 32 sucks the gas (air) in the internal space R so as to cause the medium M to make close contact with the transportation surface 224. That is to say, deformation of the medium M, such as curl, can be reduced by the suction mechanism 32. Furthermore, the suction by the suction mechanism 32 depressurizes the internal space R.

The transportation mechanism 34 transports the medium M in the Y direction (transportation direction) along the transportation surface 224. The transportation mechanism 34 in the first embodiment includes two transportation rollers 342 of which rotating axes are parallel with the X direction and a driving mechanism 344 rotating these transportation rollers 342, such as a motor. As illustrated in FIG. 2, the medium M located on the surface of the transportation surface 224 of the supporting body 22 is pinched between the two transportation rollers 342 and moves in the Y direction with rotation of the transportation rollers 342. As is understood from the above description, the medium M supplied to the internal space R through the supply port QA located at the upstream side of the transportation mechanism 34 is transported in the Y direction on the transportation surface 224 by the transportation mechanism 34, and is discharged to the outside of the main body portion 12 through the discharge port QB located at the downstream side of the transportation mechanism 34. That is to say, the transportation mechanism 34 in the first embodiment transports the medium M so as to cause the medium M to pass through the internal space R. It should be noted that a paper feeding mechanism rotating a roller around which the band-like medium M is wound and supplying the medium M to the supply port QA and/or a wind-up mechanism winding up the medium M discharged through the discharge port QB can be also used as the transportation mechanism 34.

As illustrated in FIG. 2, a liquid discharging head 42 and a carriage 44 are installed in the internal space R of the main body portion 12. Ink is supplied to the liquid discharging head 42 from the liquid containers 16. The liquid discharging head 42 discharges the ink onto the medium M in accordance with directions of various types and the image data that are transmitted from the control device 200. As illustrated in FIG. 2 in an enlarged manner, the liquid discharging head 42 discharges the ink through the plurality of nozzles N formed in a discharge surface 422 opposing the transportation surface 224 (or the medium M) of the supporting body 22. To be specific, the liquid discharging head 42 in the first embodiment includes a plurality of sets of pressure chambers and piezoelectric elements (not illustrated) corresponding to the different nozzles N. The liquid discharging head 42 in the first embodiment drives the piezoelectric elements with supply of a driving signal based on the image data and causes pressures in the pressure chambers to vary so as to discharge the ink filled into the pressure chambers through the respective nozzles N. The carriage 44 is a structure housing and supporting the liquid discharging head 42 and iteratively reciprocates along the X direction by a driving mechanism (not illustrated) including a transportation belt, a motor, and the like. The liquid discharging head 42 discharges the ink onto the medium M simultaneously with the transportation of the medium M by the transportation mechanism 34, so that an image is formed on the surface of the medium M.

As illustrated in FIG. 2, the printing apparatus 100 in the first embodiment includes a heating mechanism 52 and a heating mechanism 54 that are installed at the outside of the main body portion 12 and heats the medium M. The heating mechanism 52 is installed at the downstream side in the transportation direction of the medium M relative to the internal space R and heats the medium M discharged through the discharge port QB so as to accelerate drying of the ink on the surface of the medium M. To be specific, the heating mechanism 52 includes a transportation surface 522 and a heat generator 524, and heats the medium M that is transported along the transportation surface 522. The transportation surface 522 is inclined to be lower toward the downstream side in the transportation direction of the medium M (positive side in the Y direction) and the heat generator 524 heats the transportation surface 522. On the other hand, the heating mechanism 54 is installed at a position separated from the transportation surface 522 and heats the medium M discharged through the discharge port QB. In FIG. 1 above, the heating mechanism 54 is not illustrated for the convenience. Although the heating mechanism 54 is installed in the printing apparatus 100 in the first embodiment, the heating mechanism 54 as a separate body from the printing apparatus 100 can be installed in the vicinity of the printing apparatus 100.

As illustrated in FIG. 1 and FIG. 2, the printing apparatus 100 in the first embodiment includes a gas ejecting mechanism 60. The gas ejecting mechanism 60 in the first embodiment is installed at the downstream side in the transportation direction of the medium M when seen from the internal space R. That is to say, the gas ejecting mechanism 60 is installed at the opposite side to the internal space R with the front surface portion 244 of the housing portion 24 interposed therebetween.

Figure 3:
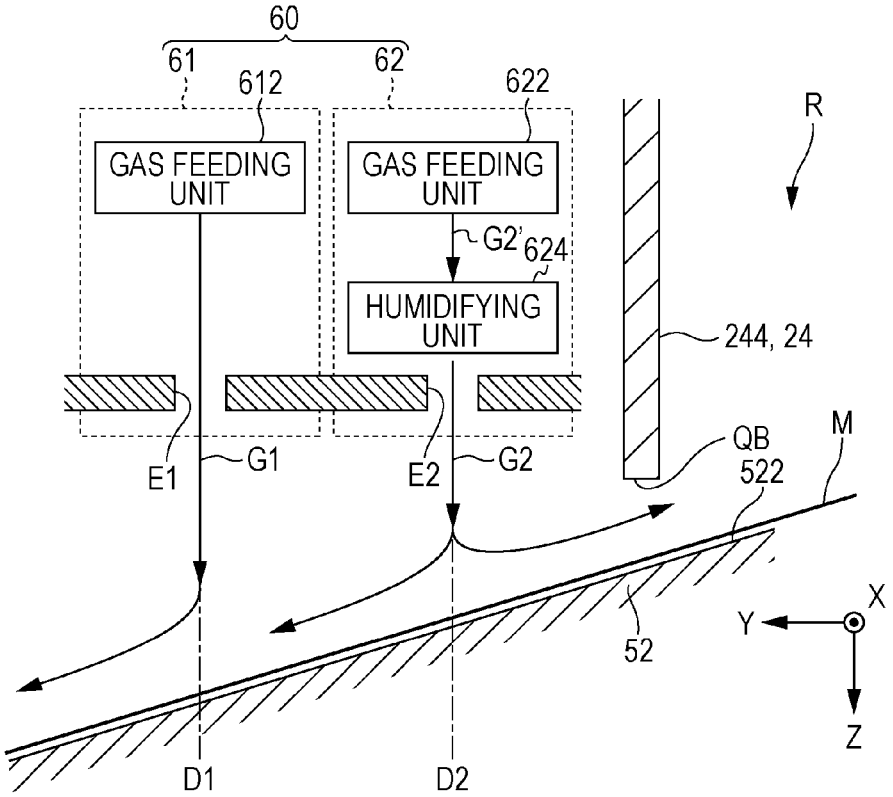
FIG. 3 is a descriptive view for explaining a gas ejecting mechanism.

FIG. 3 is a descriptive view for explaining the gas ejecting mechanism 60. As illustrated in FIG. 3, the gas ejecting mechanism 60 ejects gasses G (G1, G2) onto the medium M that is discharged through the discharge port QB. Although a typical example of the gas G is the air, for example, another gas such as an inert gas, for example, can be also used. The gas ejecting mechanism 60 in the first embodiment includes a first gas feeding mechanism 61 and a second gas feeding mechanism 62. The first gas feeding mechanism 61 ejects the gas G1 onto the medium M through an ejection port E1 and the second gas feeding mechanism 62 ejects the gas G2 onto the medium M through an ejection port E2.

To be specific, as illustrated in FIG. 3, the first gas feeding mechanism 61 includes a gas feeding unit 612. The gas feeding unit 612 is a gas feeder that supplies the gas G1 to the ejection port E1. On the other hand, the second gas feeding mechanism 62 includes a gas feeding unit 622 and a humidifying unit 624. The gas feeding unit 622 is a gas feeder that supplies gas G2' to the ejection port E2. The humidifying unit 624 humidifies the gas G2' that is supplied to the ejection port E2 from the gas feeding unit 622. The gas (humidified gas) G2 after humidified by the humidifying unit 624 is ejected onto the medium M through the ejection port E2. As is understood from the above description, the humidity of the gas G2 that is ejected through the ejection port E2 is higher than the humidity of the gas G1 that is ejected through the ejection port E1.

Figure 4:
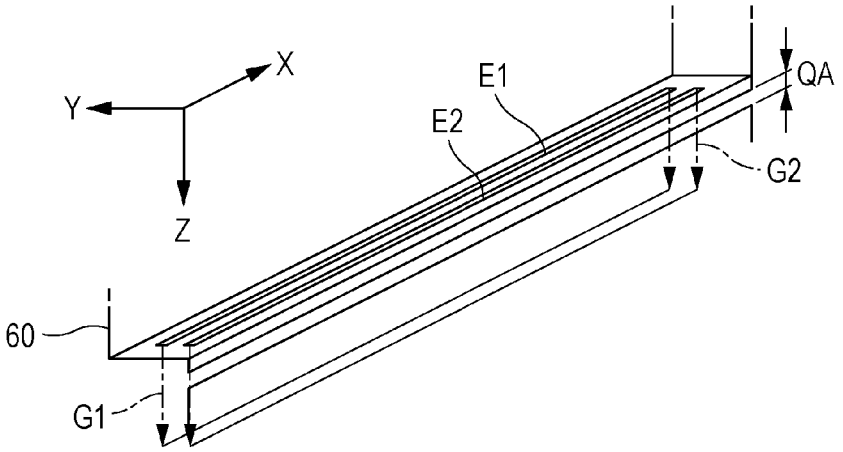
FIG. 4 is a descriptive view for explaining ejection ports of the gas ejecting mechanism.

FIG. 4 is a perspective view when the gas ejecting mechanism 60 in the first embodiment is seen from the positive side in the Z direction (medium M side). As illustrated in FIG. 4, the ejection port E1 and the ejection port E2 are formed on the surface of the gas ejecting mechanism 60, which opposes the medium M. As is understood from FIG. 3 and FIG. 4, the ejection port E2 is located between the ejection port E1 and the internal space R at the downstream side of the internal space R. That is to say, the ejection port E1 is located at the downstream side of the ejection port E2. As illustrated in FIG. 4, each of the ejection port E1 and the ejection port E2 is an opening (slit) elongated along the X direction intersecting with the Y direction in which the medium M is transported. Accordingly, each of the gas G1 that is ejected through the ejection port E1 and the gas G2 that is ejected through the ejection port E2 forms a layered air flow (so-called air curtain) that travels to the positive side in the Z direction while the X direction is set to the width direction thereof. That is to say, the air flow of the gas G1 and the air flow of the gas G2 are formed substantially in parallel at an interval in the Y direction.

As illustrated in FIG. 3, the first gas feeing mechanism 61 ejects the gas G1 in a direction D1 parallel with the Z direction and the second gas feeding mechanism 62 ejects the gas G2 in a direction D2 parallel with the Z direction. As described above, the transportation surface 522 of the heating mechanism 52 is inclined to be lower toward the downstream side and the medium M is transported along the transportation surface 522. Accordingly, the traveling direction of the gas G1 ejected through the ejection port E1 is changed to the direction along the transportation surface 522 on the surface of the medium M and the gas G1 travels to the downstream side along the transportation surface 522. On the other hand, the gas G2 ejected through the ejection port E2 hits the surface of the medium M. With this, some of the gas G2 travels to the downstream side, and merges into the gas G1 and further travels to the downstream side whereas the other thereof travels to the upstream side along the surface of the medium M and enters the internal space R through the discharge port QB. That is to say, the gas (humidified gas) G2 after humidified by the humidifying unit 624 is supplied to the internal space R and the internal space R is therefore humidified. As is understood from the above description, the second gas feeding mechanism 62 in the first embodiment functions as an element that ejects the gas G2 onto the medium M and supplies the gas G2 to the internal space R.

As described above, in the first embodiment, the gasses G (G1 and G2) are ejected onto the medium M from the gas ejecting mechanism 60 installed at the downstream side in the transportation direction of the medium M when seen from the internal space R. Therefore, the entrance of the outside air into the internal space R is inhibited by the air flow of the gas G. Accordingly, drying of the internal space R due to the entrance of the outside air can be suppressed. In the first embodiment, the gas G is ejected through each of the ejection port E1 and the ejection port E2 elongated in the X direction intersecting with the transportation direction of the medium M, so that the layered air flow (air curtain) is formed. Accordingly, an effect that the entrance of the outside air is inhibited is obtained extremely remarkably. Further, in the first embodiment, the first gas feeding mechanism 61 and the second gas feeding mechanism 62 form the air flow of a plurality of layers. Therefore, the entrance of the outside air into the internal space R can be suppressed effectively in comparison with the configuration in which the air flow of a single layer is formed. In the first embodiment, there is a circumstance that the suction by the suction mechanism 32 depressurizes the internal space R and the outside air is therefore easy to enter the internal space R through the discharge port QB. In consideration of the above circumstance, the first embodiment capable of inhibiting the entrance of the outside air into the internal space R is very effective.

When the internal space R is dried, the ink is thickened in the nozzles N because of water evaporation or the like, for example, and appropriate discharge of the ink is possibly inhibited, as a result. Particularly in the first embodiment, the internal space R is easy to be dried when the outside air heated by the heating mechanism 52 and the heating mechanism 54 enters the internal space R through the discharge port QB. Accordingly, the first embodiment capable of suppressing the entrance of the outside air into the internal space R with the ejection of the gas G onto the medium M is particularly effective. Moreover, when the internal space R is excessively dried, deterioration of individual parts (for example, the liquid discharging head 42, the carriage 44, and the like) installed in the internal space R possibly progresses. According to the first embodiment, there is an advantage that the deterioration of the individual parts installed in the internal space R can be suppressed because the drying of the internal space R is suppressed as described above.

In the first embodiment, the gas G2 after humidified by the humidifying unit 624 is ejected onto the medium M so as to be supplied to the internal space R. Accordingly, the entrance of the outside air into the internal space R can be suppressed by the air flow of the gas G2 and the internal space R can be humidified by the supply of the gas G2. That is to say, both of the suppression of the entrance of the outside air into the internal space R and the humidification of the internal space R are achieved by the gas G2. Accordingly, drying of the internal space R can be suppressed effectively in comparison with the configuration in which the dried gas is ejected onto the medium M.

As described above, in the first embodiment, drying of the internal space R is suppressed and thickening of the ink in the individual nozzles N of the liquid discharging head 42 is therefore suppressed. Accordingly, there is an advantage that the ink can be discharged under appropriate conditions (discharge amount and discharge direction) even when the ink is ejected at a time point at which a long period of time has passed from the last discharge of the ink. That is to say, there is an advantage that performance of discharging the ink intermittently at an interval of a long period of time can be kept. With the configuration in which the internal space R is easy to be dried, a moisturizer for suppressing the thickening of the ink because of the water evaporation can be added to the ink. In the first embodiment, drying of the internal space R (that is, thickening of the ink because of the water evaporation) is suppressed as described above. Therefore, an addition amount of the moisturizer can be reduced (eliminated, ideally). Further, the reduction in the addition amount of the moisturizer makes the ink on the surface of the medium M discharged through the discharge port QB easy to be dried. This enables a heating amount (temperature) and heating time by the heating mechanism 52 and the heating mechanism 54 to be reduced. Accordingly, there are advantages that printing efficiency (number of print pages per unit time) is improved and power consumption of the heating mechanism 52 and the heating mechanism 54 are reduced. Further, when glycerin as a moisturizer is added to sublimation transfer ink, for example, there is a possibility that the glycerin is vaporized when heated at the time of transfer and steam is generated. In the first embodiment, the suppression of the drying of the internal space R can reduce the addition amount of the moisturizer, thereby also obtaining an advantage that an amount of the steam of the glycerin can be reduced when the sublimation transfer ink is transferred.

Figure 5:
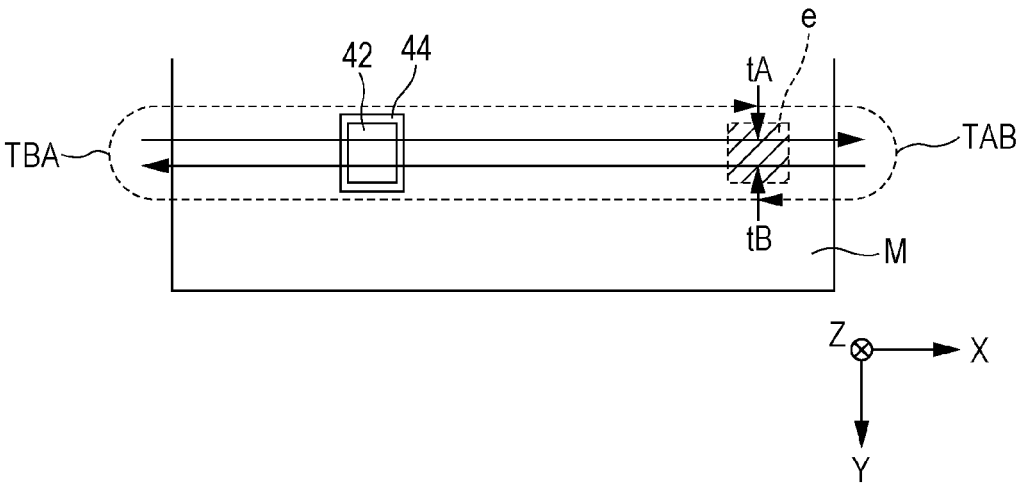
FIG. 5 is a descriptive view for explaining an effect (reduction in color unevenness) in the first embodiment.

In a serial-type printing apparatus 100 in which the liquid discharging head 42 reciprocates along the X direction, a time interval at which the ink is sequentially discharged onto regions of the medium M in the vicinity of end portions in the width direction, in particular, can be different in accordance with the movement direction of the liquid discharging head 42. For example, FIG. 5 illustrates a time point to at which the ink is discharged onto a region "e" of the medium M in a process in which the liquid discharging head 42 is moved to the positive side in the X direction and a time point tB at which the ink is discharged onto the region "e" of the medium M in a process in which the liquid discharging head 42 is moved to the negative side in the X direction. An interval TAB from the time point tA to the time point tB is shorter than an interval TBA from the time point tB to the time point tA. Accordingly, a dry state, at the time point tB, of the ink discharged at the time point tA can be different from a dry state, at the time point tA, of the ink discharged at the time point tB. Further, due to the difference in the dry state, characteristics (for example, hue and saturation) of an image that is printed on the surface of the medium M are different between the ink at the time point tA and the ink at the time point tB. As a result, the difference is possibly perceived as color unevenness in the vicinity of both the end portions of the medium M. The color unevenness as described above is more significant as a drying speed of the ink in the internal space R is higher (as the difference in the dry state is larger). According to the first embodiment, there is an advantage that the color unevenness due to the difference in the dry state is reduced because the drying of the internal space R is suppressed as described above. The difference in the dry state (that is, the color unevenness due to the difference) is easier to be generated as a reciprocating range of the liquid discharging head 42 is larger. In consideration of the above circumstance, the first embodiment capable of reducing the color unevenness with the suppression of the drying of the internal space R is extremely suitable for the printing apparatus 100 capable of performing printing of the large-sized medium M of equal to or larger than A2 as described above.

Second Embodiment

A second embodiment of the invention will be described. In each of embodiments as will be described later, the reference numerals used in the description of the first embodiment are applied to elements having actions and functions that are the same as those in the first embodiment and detail description thereof is appropriately omitted.

Figure 6:
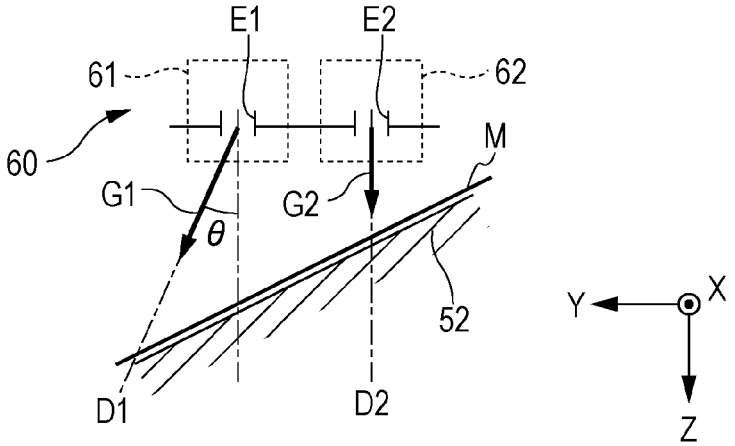
FIG. 6 is a descriptive view for explaining a gas ejecting mechanism in a second embodiment.

FIG. 6 is a descriptive view for explaining the gas ejecting mechanism 60 in the second embodiment. In the first embodiment, both of the gas G1 and the gas G2 are ejected in the directions (D1 and D2) parallel with the Z direction. As illustrated in FIG. 6, the first gas feeding mechanism 61 in the second embodiment ejects the gas G1 through the ejection port E1 in the direction D1 inclined, by an angle θ, to the downstream side in the transportation direction of the medium M along the positive side in the Z direction (downward direction in the vertical direction). The angle θ is an acute angle ($0<\theta<90°$). To be specific, the shape of the ejection port E1 and the air feeding direction by the gas feeding unit 612 are selected such that the gas G1 is ejected in the direction D1. On the other hand, the second gas feeding mechanism 62 ejects the gas G2 in the direction D2 parallel with the Z direction in the same manner as the first embodiment.

Effects that are the same as those obtained in the first embodiment are also obtained in the second embodiment. Further, in the second embodiment, the gas G1 is ejected in the direction D1 inclined to the downstream side along the Z direction. Therefore, the travelling direction of the gas G1 that has reached the vicinity of the surface of the medium M through the ejection port E1 changes on the surface of the medium M smoothly. Accordingly, there is an advantage that generation of turbulent flow due to impact of the gas G1 against the medium M can be suppressed.

Third Embodiment

Figure 7:
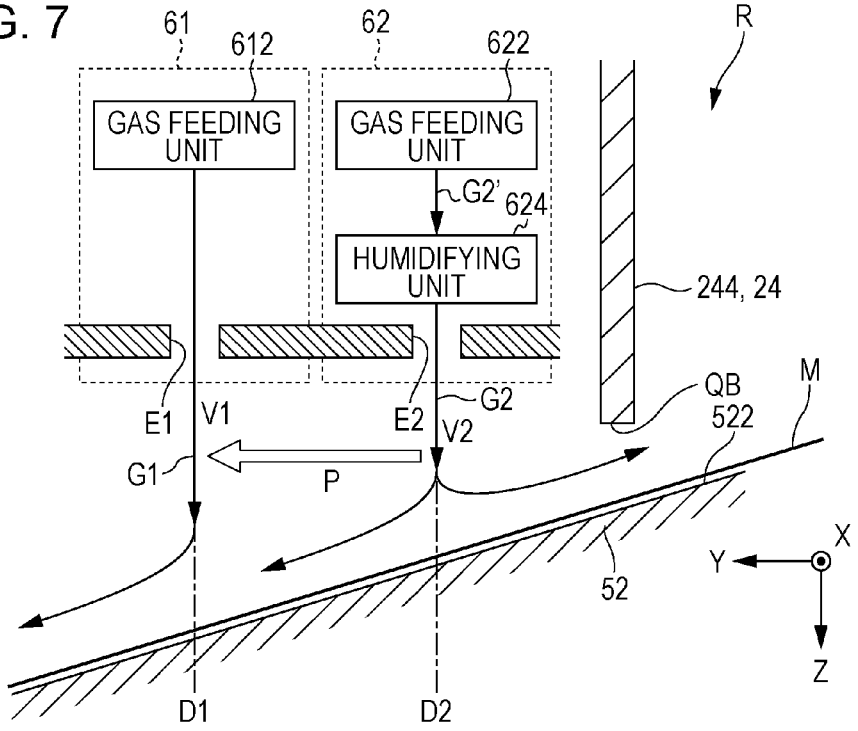
FIG. 7 is a descriptive view for explaining a gas ejecting mechanism in a third embodiment.

FIG. 7 is a descriptive view for explaining the gas ejecting mechanism 60 in a third embodiment. In the third embodiment, a flow rate V1 of the gas G1 that the first gas feeding mechanism 61 ejects through the ejection port E1 and a flow rate V2 of the gas G2 that the second gas feeding mechanism 62 ejects through the ejection port E2 are different. To be specific, the flow rate V2 of the gas G2 is lower than the flow rate V1 of the gas G1 ($V2<V1$). Accordingly, as illustrated by an outlined arrow in FIG. 7, a pressure P toward the air flow of the gas G1 that is ejected through the ejection port E1 from the air flow of the gas G2 that is ejected through the ejection port E2 is generated. The pressure P acts so as to draw the gas G2 ejected through the ejection port E2 to the gas G1 side (positive side in the Y direction). Accordingly, in comparison with the configuration in which the flow rate V1 and the flow rate V2 are equal to each other, a volume of the gas G2 ejected through the ejection port E2, which travels to the downstream side together with the gas G1, is increased whereas a volume of the gas G2, which enters the internal space R through the discharge port QB, is decreased.

The same effects as those obtained in the first embodiment are also obtained in the third embodiment. Further, in the third embodiment, the flow rate V2 of the gas G2 that is ejected through the ejection port E2 is lower than the flow rate V1 of the gas G1 that is ejected through the ejection port E1. Therefore, a possibility that the gas G2 after humidified by the humidifying unit 624 excessively enters the internal space R is reduced. Accordingly, there is an advantage that excessive humidification of the internal space R can be suppressed. The configuration in the second embodiment in which the gas G1 is ejected in the direction D1 inclined by the angle θ with respect to the Z direction can be also applied to the third embodiment.

Fourth Embodiment

Figure 8:
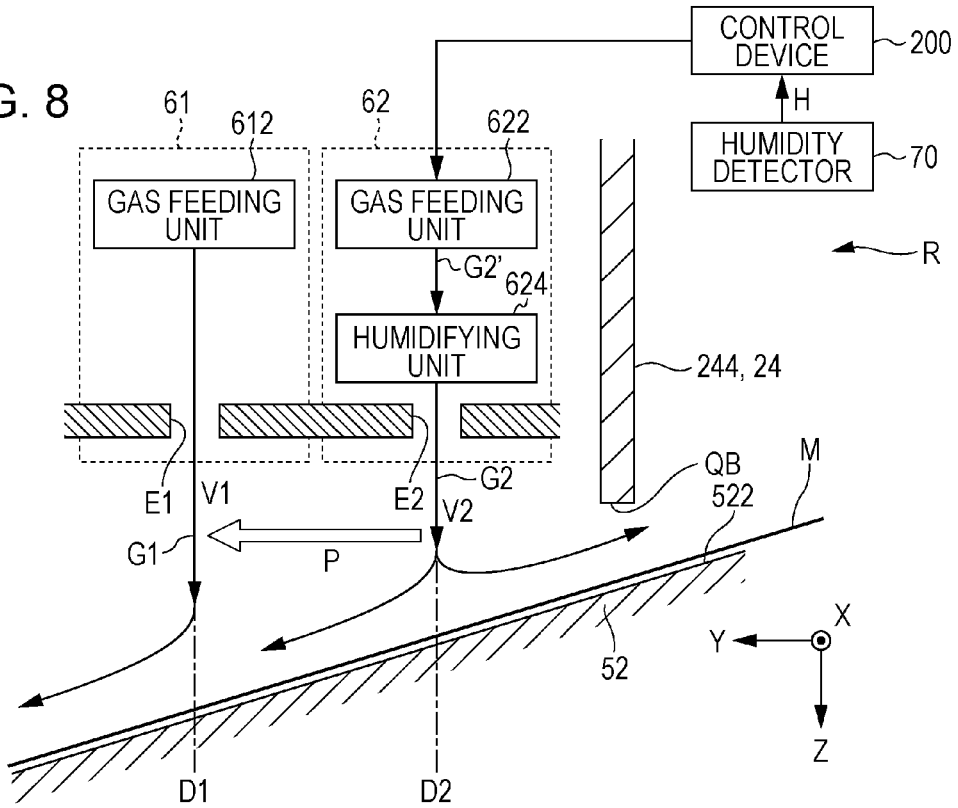
FIG. 8 is a descriptive view for explaining a gas ejecting mechanism in a fourth embodiment.

FIG. 8 is a descriptive view for explaining the gas ejecting mechanism 60 in a fourth embodiment. As is understood from the description in the third embodiment, the pressure P is increased as the difference (V1−V2) between the flow rate V1 of the gas G1 that is ejected through the ejection port E1 and the flow rate V2 of the gas G2 that is ejected through the ejection port E2 is larger. Accordingly, as the flow rate V2 is lower than the flow rate V1 (that is, as the pressure P is higher), a volume (hereinafter, referred to as "entrance amount") of the gas G2 ejected through the ejection port E2, which enters the internal space R through the discharge port QB, is decreased. In consideration of the above tendency, in the fourth embodiment, the entrance amount of the gas G2 into the internal space R is adjusted by controlling the flow rate V1 of the gas G1 and the flow rate V2 of the gas G2. To be specific, the gas feeding unit 622 of the second gas feeding mechanism 62 variably sets the flow rate V2 of the gas G2 in accordance with a direction from the control device 200, for example.

As illustrated in FIG. 8, a humidity detector 70 is installed in the internal space R. The humidity detector 70 is a hygrometer that measures humidity H in the internal space R. The control device 200 controls the second gas feeding mechanism 62 such that the flow rate V2 of the gas G2 changes in accordance with the humidity H in the internal space R, which has been detected by the humidity detector 70. To be specific, the control device 200 controls the gas feeding unit 622 of the second gas feeding mechanism 62 such that the flow rate V2 is increased (difference between the flow rate V2 and the flow rate V1 is decreased) as the humidity H is lower. Accordingly, the pressure P is lowered as the humidity H of the internal space R is lower and the entrance amount of the gas G2 into the internal space R is increased, as a result. As is understood from the above description, the entrance amount of the gas G2 can be adjusted such that the humidity H in the internal space R is close to a target value.

The same effects as those obtained in the first embodiment and the third embodiment are also obtained in the fourth embodiment. Further, in the fourth embodiment, there is an advantage that the humidity H in the internal space R can be adjusted appropriately because the entrance amount of the gas G2 into the internal space R can be set variably by controlling the flow rate V2 of the gas G2 in accordance with the humidity H in the internal space R. Although the flow rate V2 of the gas G2 is controlled in the above description, the configuration controlling the flow rate V1 of the gas G1 or the configuration controlling both of the flow rate V1 and the flow rate V2 can be also employed. The configuration in which at least one of the flow rate V1 and the flow rate V2 is controlled such that the difference between the flow rate V1 and the flow rate V2 is decreased (that is, the pressure P is lowered and the entrance amount of the gas G2 into the internal space R is increased) as the humidity H in the internal space R is lower is preferable. It should be noted that the configuration in the second embodiment in which the gas G1 is ejected in the direction D1 inclined by the angle θ with respect to the Z direction can be also applied to the fourth embodiment.

Variations

The embodiments as described above can be varied in a diversified manner. Detail variations will be described below. Equal to or more than two modes arbitrarily selected from the following description can be combined appropriately within a range consistent with each other.

1. Although the gas ejecting mechanism 60 is installed at the downstream side in the transportation direction of the medium M when seen from the internal space R in each of the above-described embodiments, the gas ejecting mechanism 60 can be also installed at the upstream side of the internal space R instead of the above configuration (or together with the above configuration). The gas ejecting mechanism 60 at the upstream side of the internal space R ejects the gas G onto the medium M that is supplied to the supply port QA so as to inhibit entrance of the outside air into the internal space R through the supply port QA.

2. Although the gas ejecting mechanism 60 includes one ejection port E1 and one ejection port E2 as described with reference to FIG. 4 in each of the above-described embodiments, the configuration in which a plurality of ejection ports E1 are aligned in the X direction or the configuration in which a plurality of ejection ports E2 are aligned in the X direction can be also employed.

3. Although the gas feeding unit 612 of the first gas feeding mechanism 61 and the gas feeding unit 622 of the second gas feeding mechanism 62 are configured as different elements in the first embodiment, the gas feeding unit 612 can be also used commonly by the first gas feeding mechanism 61 and the second gas feeding mechanism 62. To be specific, the gas G1 fed from the gas feeding unit 612 of the first gas feeding mechanism 61 is branched to a first flow path at the ejection port E1 side and a second flow path at the humidifying unit 624 side and the humidifying unit 624 of the second gas feeding mechanism 62 humidifies the gas G1 that is supplied to the second flow path so as to supply it as the gas G2 to the ejection port E2. This configuration can omit the gas feeding unit 622 of the second gas feeding mechanism 62, thereby obtaining an advantage that the configuration of the gas ejecting mechanism 60 is simplified.

4. Although the printing apparatus 100 includes both of the first gas feeding mechanism 61 and the second gas feeding mechanism 62 in each of the above-described embodiments, the configuration in which one of the first gas feeding mechanism 61 and the second gas feeding mechanism 62 is omitted or the configuration in which another gas feeding mechanism is added to the first gas feeding mechanism 61 and the second gas feeding mechanism 62 can be also employed.

5. The configuration of the liquid discharging head 42 is changed appropriately. For example, although the piezoelectric-type liquid discharging head 42 using the piezoelectric elements applying mechanical vibration to the pressure chambers is employed in each of the above-described embodiments, a thermal-type liquid discharging head using heat generation elements generating air bubbles in the pressure chambers by heating can be also employed.

6. The printing apparatus 100 as described in each of the above-described embodiments can be also applied to apparatuses of various types, such as a facsimile apparatus and a copying apparatus, in addition to the apparatus that is used exclusively for printing. It is needless to say that the application of the liquid discharging apparatus in the invention is not limited to printing. For example, a liquid discharging apparatus that ejects a solution of a coloring material is used as a manufacturing apparatus forming a color filter of a liquid crystal display apparatus. Further, a liquid discharging apparatus that ejects a solution of a conductive material is used as a manufacturing apparatus forming wiring and an electrode of a wiring substrate.

The present application claims priority to Japanese Patent Application No. 2015-049848 filed on Mar. 12, 2015, which is hereby incorporated by reference in its entirety.

What is claimed is:

1. A liquid discharging apparatus comprising:

a housing portion that forms an internal space;

a transportation mechanism that transports a medium so as to cause the medium to pass through the internal space;

a liquid discharging head that is installed in the internal space and discharges liquid onto the medium; and a first gas feeding mechanism that ejects gas onto the medium through a first ejection port at a downstream side in a transportation direction of the medium when seen from the internal space.

2. The liquid discharging apparatus according to claim 1, wherein the first ejection port has a shape elongated in a direction intersecting with the transportation direction of the medium.

3. The liquid discharging apparatus according to claim 1, further includes a second gas feeding mechanism that ejects gas onto the medium through a second ejection port between the first ejection port and the internal space.

4. The liquid discharging apparatus according to claim 3, wherein the second gas feeding mechanism ejects humidified gas onto the medium so as to supply the humidified gas into the internal space.

5. The liquid discharging apparatus according to claim 3, wherein a flow rate of the gas that the second gas feeding mechanism ejects through the second ejection port is lower than a flow rate of the gas that the first gas feeding mechanism ejects through the first ejection port.

6. The liquid discharging apparatus according to claim 3, further includes a controller controlling at least one of a flow rate of the gas that is ejected by the first gas feeding mechanism and a flow rate of the gas that is ejected by the second gas feeding mechanism.

7. The liquid discharging apparatus according to claim 6, further includes a humidity detector that detects humidity of the internal space, wherein the controller controls at least one of the flow rate of the gas that is ejected by the first gas feeding mechanism and the flow rate of the gas that is ejected by the second gas feeding mechanism in accordance with the humidity detected by the humidity detector.

8. The liquid discharging apparatus according to claim 1, further includes a heating mechanism that is installed at an outside of the internal space and heats the medium.

9. The liquid discharging apparatus according to claim 1, wherein the first gas feeding mechanism is installed at the downstream side in the transportation direction of the medium when seen from the internal space and ejects the gas in a direction inclined to the downstream side in the transportation direction of the medium along a downward direction in a vertical direction.

10. A liquid discharging apparatus comprising:

a housing portion that forms an internal space;

a transportation mechanism that transports a medium so as to cause the medium to pass through the internal space;

a liquid discharging head that is installed in the internal space and discharges liquid onto the medium;

a first gas feeding mechanism that ejects gas onto the medium through a first ejection port at a downstream side in a transportation direction of the medium when seen from the internal space;

a second gas feeding mechanism that ejects gas onto the medium through a second ejection port between the first ejection port and the internal space; and a humidity detector that detects humidity of the internal space, wherein the controller controls at least one of the flow rate of the gas that is ejected by the first gas feeding mechanism and the flow rate of the gas that is ejected by the second gas feeding mechanism in accordance with the humidity detected by the humidity detector.

11. The liquid discharging apparatus according to claim 10, wherein the second gas feeding mechanism ejects humidified gas onto the medium so as to supply the humidified gas into the internal space.

12. The liquid discharging apparatus according to claim 10, further includes a heating mechanism that is installed at an outside of the internal space and heats the medium.

13. The liquid discharging apparatus according to claim 10, wherein the first gas feeding mechanism is installed at the downstream side in the transportation direction of the medium when seen from the internal space and ejects the gas in a direction inclined to the downstream side in the transportation direction of the medium along a downward direction in a vertical direction.

* * * * *